United States Patent [19]

d'Argembeau

[11] 4,233,260

[45] Nov. 11, 1980

[54] PROCESS FOR THE MANUFACTURE OF BRUSHES

[76] Inventor: Etienne, Y. G. J. d'Argembeau, 14 Rue de Belle-Vue, B-1050Brussels, Belgium

[21] Appl. No.: 13,995

[22] Filed: Feb. 22, 1979

[30] Foreign Application Priority Data

Feb. 28, 1978 [LU] Luxembourg ..... 79138

[51] Int. Cl.[3] ..... B29D 31/00

[52] U.S. Cl. ..... 264/243; 264/157; 264/231; 264/271; 300/17; 300/21; 264/328.1; 264/328.2

[58] Field of Search ..... 264/229, 231, 261, 328, 264/271, 157, 243, 229, 231, 263, 259; 425/122, 111; 15/167 R; 300/21, 17

[56] References Cited

U.S. PATENT DOCUMENTS

| | | | |
|---|---|---|---|
| 1,202,244 | 10/1916 | Timmis | 264/243 |
| 1,413,211 | 4/1922 | Albright | 264/243 |
| 2,457,440 | 12/1948 | Booth | 264/243 |
| 2,495,666 | 1/1950 | Taubert | 264/243 |
| 3,926,201 | 12/1975 | Katz | 264/157 |
| 4,006,750 | 2/1977 | Chodorow | 264/271 |
| 4,029,453 | 6/1977 | Campion | 42 5/111 |

*Primary Examiner*—Donald J. Arnold
*Attorney, Agent, or Firm*—Sughrue, Rothwell, Mion, Zinn and Macpeak

[57] ABSTRACT

This invention relates to a process for the manufacture of brushes particularly tooth-brushes, comprising a bristle-carrying head and possibly a handle in synthetic material fixed to the head.

According to this invention, the piles are positioned in a mold by causing them to cross entirely the mold and to project outside of two opposite parts of the mold, the latter having an inner volume or capacity corresponding to at least one brush head and possibly one handle for such a head, a synthetic liquid or pasty synthetic material, such as a prepolymer or a synthetic resin, being then injected into the mold so as to cause the piles to be embedded into said synthetic material and to be surrounded by synthetic material having the shape of at least one head and possibly of at least one handle integral with said head(s).

7 Claims, 6 Drawing Figures

FIG. 1
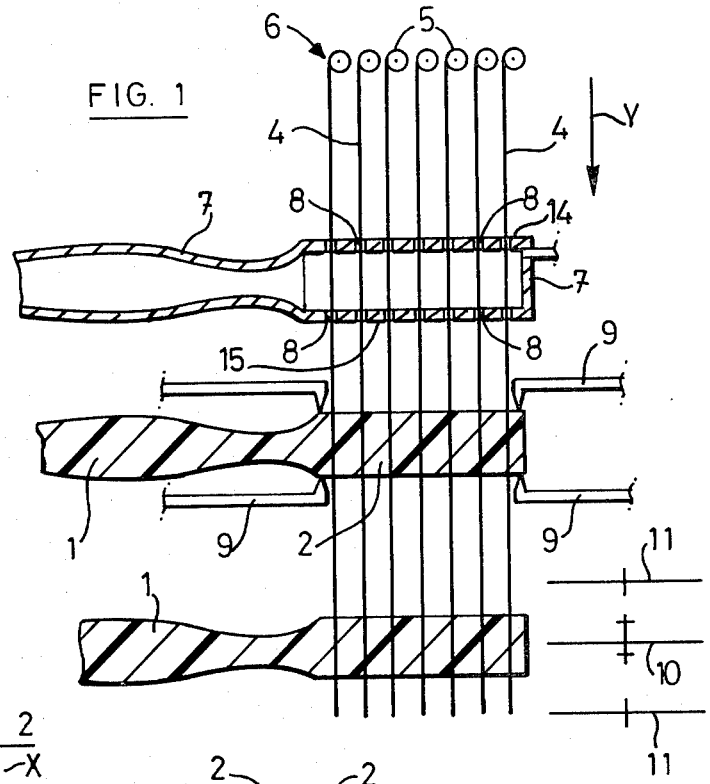
FIG. 2
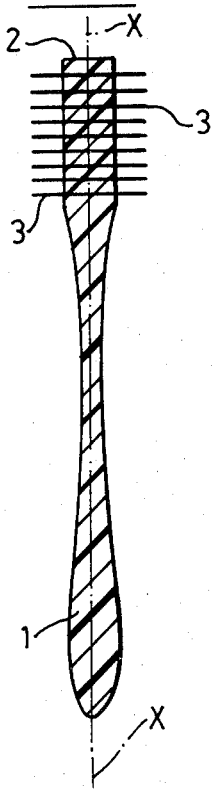
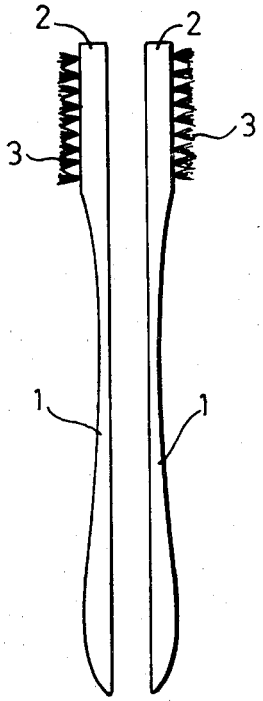
FIG. 3

PROCESS FOR THE MANUFACTURE OF BRUSHES

PRIOR ART

In known processes for manufacturing toothbrushes, a mold having an inner volume corresponding, in fact, to the volume of the head and of the handle is used. In other words, the inner wall of the mold, when closed, is substantially identical to the outer face of the brush head and handle. Moreover, the head is provided on one side with holes in which pile wicks or bundles are to be partially inserted, said wicks or bundles being free at one end and maintained by means of a small ring or U-shaped piece frequently made of a metal, said ends provided with rings or U-shaped pieces being introduced into holes provided in the molded head.

After the liquid synthetic material is injected into the mold and after demolding of the brush head and handle, the pile wicks or bundles are inserted in the holes provided in the head. After the synthetic material has been distributed, within the mold, the mold is heated or cooled so as to cause the synthetic material, which may be a thermoplastic or thermohardening resin, to become hard or at least self-sustaining. Finally, pile wicks or bundles are inserted in the head, the latter carrying thus rows of pile wicks or bundles.

The known process for the manufacture of tooth-brushes have several drawbacks.

The manufacture of the known brushes is made in molds in which the heads attached to the handles are individually manufactured. The brushes are thus manufactured separately in each used mold. The successive steps of injecting the synthetic material into the mold, of hardening said synthetic material, of removing the brushes from the molds and of positioning the pile wicks or bundles in the molded heads are time-consuming, so that the production cadence is low.

Moreover, the manufacture of known tooth-brushes or other brushes needs the preparation of pile wicks or bundles cut at the desired length, folded in two parts of equal length and maintained together near the folding area by means of small rings or U-shaped pieces frequently made of metal.

Furthermore, each so formed wick must be correctly positioned in holes of the heads. The preparation of the mile wicks and the positioning thereof in the heads are lengthy and expensive operations which have a substantial detrimental effect on the cost price of the produced brushes.

BRIEF DESCRIPTION OF THE INVENTION

It is an object of the present invention to provide a new process for the manufacture of brushes which does not have the abovenamed drawbacks of the known methods.

In the present specification and in the claims, the term "bristle" means not only usual bristles, but also monofilament or polyfilament yarns or fibers, as well as pile, yarn or fiber tufts.

According to this invention, the piles are positioned in a mold by causing them to cross entirely the mold and to project outside of two opposite parts of the mold, the latter having an inner volume or capacity corresponding to at least one brush head and possibly one handle for such a head, a synthetic liquid or pasty synthetic material, such as a prepolymer of a synthetic resin, being then injected into the mold so as to cause the piles to be embedded into said synthetic material and to be surrounded by synthetic material having the shape of at least one head and possibly of at least one handle integral with said head(s).

After the synthetic material has been at least partially hardened or become self-sustaining, so as to be at a temperature at which said material maintains its molded shape, the piles are cut close to one face of the molded head, while being maintained at the desired length on the opposite face of said head.

DETAILED DESCRIPTION OF THE INVENTION

According to one embodiment of the process according to the present invention, at least two assemblies of brush heads and possibly corresponding handles are molded together in a single mold so that, when said assemblies are removed from the mold, they form at least two brushes placed back to back. In this case, the obtained assemblies (see FIG. 2) are then cut in longitudinal direction through the head and handle units. For example, two units of brush head and possibly corresponding handles are molded together in a single mold so as to obtain a single element made of two brushes placed back to back, this single element being divided into two individual brushes, by cutting the unit midway in the direction of the longitudinal axis of the assembly through the head and handle assembly, the pile wicks projecting on opposite sides of said assembly being also cut at the desired length.

According to a second embodiment of the process according to this invention, a single brush head integral with its handle (if any) is molded in the mold through which a plurality of pile yarns extends in a direction which is perpendicular to the longitudinal axis of the head and after removing the shaped brush from the mold, the yarns are cut on on side of the head to as to be flush with the surface of that side of the head.

According to a feature of the process according to the invention, continuous monofilament or polyfilament yarns to be used for forming pile wicks or bundles of the brushes are caused to pass continuously through small holes provided in two opposite parts of the mold, these yarns being preferably drawn from several sources, such as bobbins, so as to be parallel and close to each other on their path towards the mold.

The parallel yarns preferably extend in a vertical direction towards the mold having a longitudinal axis which is perpendicular to the array of parallel yarns.

By using the feature disclosed in the two preceding paragraphs, the manufacture of brushes is practically continuous.

According to a feature of the second embodiment of the process according to this invention, the distance between two successively molded brushes is selected in such a manner that it is possible, by cutting operations, to obtain successive brushes having pile wicks or bundles having the desired length on one face of their head and not projecting from the opposite face of the brush. In other words, the distance between two successively molded brushes is selected so that, when the cutting operations of the yarns are effected, the head of the firstly molded brush has projecting pile wicks of the desired length, on one face, whereas the yarns are cut closely flush to the opposite face of the secondly molded brush.

In order to obtain a uniform production of the brushes, a traction or pulling force is exerted on the array of parallel monofilament or polyfilament yarns so as to submit these yarns to a suitable tension, while they cross or traverse the mold and are molded therein.

The cutting operation(s) may be performed mechanically and/or thermally and/or optically. It is preferred to perform the cutting operation(s) by means of a laser beam emitting device, due to the high potency, high directivity and monochromaticity of the focus of a lens, as known by the people skilled in that art.

The invention also relates to brushes obtained by the new process.

DETAILED DESCRIPTION OF EMBODIMENTS OF THE INVENTION

Other features and details of the invention will appear from the following description of two embodiments of the invention in which reference is made to the attached drawings, in which:

FIG. 1 shows diagrammatically a first embodiment of the process used, by way of example, for the manufacture of tooth brushes;

FIG. 2 is a front view of a double brush obtained in an intermediate step of the process illustrated in FIG. 1;

FIG. 3 is a front view of two single toothbrushes obtained simultaneously at the end of the process diagrammatically shown in FIG. 1;

A tooth brush as shown in FIG. 3 comprises, as known, a handle 1, a head 2 integral with said handle 1 and projecting pile wicks or bundles 3. The handle 1 and the head 2 are made of a molded synthetic material, such as a thermoplastic or thermohardening synthetic resin. The handle 1, the head 2 and the pile wicks 3 may, for example, be made of nylon.

Figure 4:
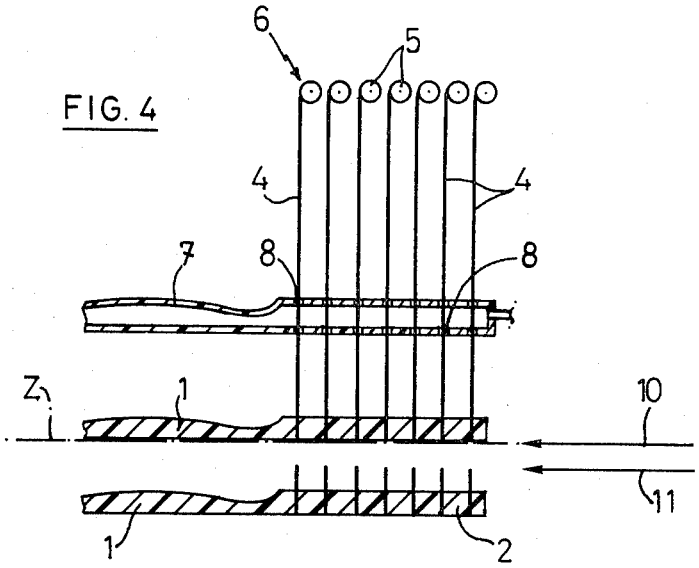
FIG. 4 shows schematically a second embodiment of the new process for manufacturing, for example, toothbrushes.
Figure 5:
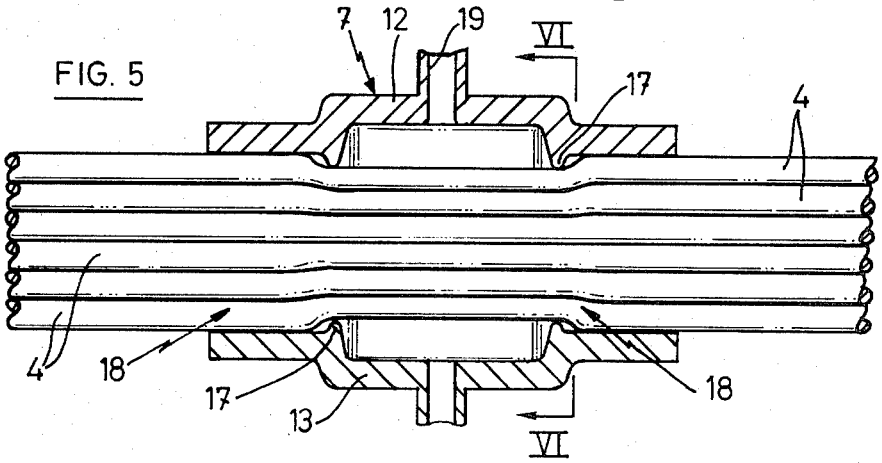
FIGS. 5 and 6 represent, at a larger scale, respectively in longitudinal and transversal section, along the lines VI—VI and V—V respectively, a mold used in the process according to this invention.

For manufacturing the tooth brush, continuous synthetic or natural monofilament or polyfilament yarns 4 are drawn from bobbins carried by a reel 6. The yarns 4 extend as an array of yarns parallel and close to each other at least near a mold 7 consisting for example of two complementary parts 12 and 13 (as shown in FIGS. 4 and 5). Two opposite walls 14 and 15 have small holes 8 therein, said holes being possibly staggered in several rows.

In the embodiment of the process according to the invention shown in FIG. 1, the inner volume or capacity of the closed mold 7 substantially corresponds to the volume occupied by two tooth-brushes placed in face of each other and having their heads and handles positioned back to back (see FIG. 2).

The yarns are caused to traverse or cross the holes 8 which are opposite to each other, so that an array of parallel and close together monofilament or polyfilament yarns 4 extend within the mold in a direction which is perpendicular to the longitudinal axis of the mold 7.

In order to maintain the yarns parallel to each other within the mold 7, these yarns are preferably submitted to a drawing or pulling force.

Periodically and at regular time intervals, the advancement of the array of yarns 4 in the direction of arrow Y is stopped. During each stop, a liquid or pasty thermoplastic or thermohardening synthetic material, such as prepolymer or a monomer, is injected into the mold 7, so as to embed the parts of the continuous yarns 4 extending in the mold 7 into said material. When the mold 7 is full of synthetic material, the latter is cooled or heated to a temperature causing a hardening thereof. After said hardening, the mold 7 is opened and a double tooth-brush as shown in FIG. 2 is obtained.

It may be advantageous to maintain the yarn parts or sections extending in the mold at a temperature at which said yarn parts are softened. Due to this softening, a firm anchoring of said yarn sections in the molded heads is obtained.

When the head 2 has been molded around the yarn sections extending in the mold 7, the array of yarns 4 to which a double tooth-brush (as shown in FIG. 2) is suspended is again moved in the direction of arrow Y so as to bring said double tooth-brush between grips of a clamping and stopping device 9. The so clamped double-brush is then cut along its median symmetry plane X (see FIG. 2) by means of a cutting device 10. Simultaneously, tight yarn sections having a length which is equal to the desired height of the pile wicks of the tooth-brushes are cut either on both sides of the double tooth-brush head or at least on the side of the mold 7 by another cutting device 11, the other yarns on the opposite side having, for example, previously been cut. The cutting devices may be of any known mechanical, thermal and/or optical type; however, it is preferred to use a known laser beam emitting device.

Finally, a traction is again exerted on the free ends of yarns 4 in order to cause advancing of the continuous array of yarns into the mold.

In the embodiment schematically shown in FIG. 4, a single tooth-brush head and assembly is molded in mold 7, in the above described manner. However, when said assembly is removed from the mold 7, the yarns 4 are first cut along a plane Z which is coplanar with the lower surface 14 of the molded tooth-brush head 2, so that no yarns project from said surface. Said cutting can be effected by means of mechanical and/or thermal and/or optical devices, such as a laser beam emitting device. After said first cutting, the yarns 4 projecting from the opposite surface of the brush head are cut to the desired length. It thus appears that only two cuttings are necessary when a single tooth-brush head and handle assembly is molded according to the method illustrated in FIG. 4.

Figure 6:
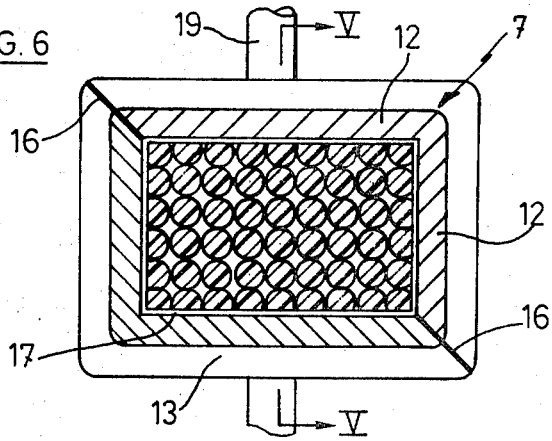

FIGS. 5 and 6 show, by way of example, a mold 7 comprising two parts 12 and 13 connected along the corners 16 and having an inlet 19. In order to avoid leakage of the synthetic material injected into said mold, each mold part 12, 13 has an inner flange 17 which compresses the bundle of tangent yarns entering and leaving the mold through the open ends 18 of the latter. The withdrawal of the molded brush blank can be effected by driving means causing the opening of the mold by a relative movement of parts 12, 13 thereof.

The invention is of course not limited to the above described details, since many changes may be made in said details within the scope of the invention.

For example, it is possible, within the scope of the invention, to mold several assemblies of double brushes in a single mold, said assemblies or units being superimposed or placed side by side in said mold. In such a case, cutting means are used for simultaneously or successively separate said assemblies from each other and for dividing each individual assembly into individual brushes. In this manner, a great number of brushes can be manufactured by using a single mold.

Moreover, instead of molding an assembly of two heads and handles placed back to back and welded together as shown in FIG. 2, it is possible within the scope of the invention, to mold two brush heads and handles together in the same mold, so that the molded brush heads and handles are still placed back to back but with a very short interval between the facing surfaces thereof. In the latter case, it is only necessary to cut the very short sections of yarns extending between said surfaces. For avoiding the molding of an integral assembly of two brush heads and handles and leaving a short interval between the two molded brush heads and handles, it is sufficient to provide a thin separating wall in the mold.

What I claim is:

1. A process for the continuous manufacture of tooth brushes comprising a bristle or pile carrying head and a handle integral with said head, said process comprising:

drawing substantially parallel and continuous monofilament or polyfilament yarns from supply means in a substantially vertical direction so as to entirely cross at least one mold cavity having the shape of two of said brush handles and heads placed back to back so as to project outside two opposite sides of said mold in a direction substantially perpendicular to said mold cavity at a part of said cavity having said shape of two brush heads placed back to back;

injecting a synthetic liquid or pasty thermoplastic or thermohardening material into said mold cavity so as to cause said parts of said parallel yarns crossing said mold cavity to be embedded into said synthetic material, to thereby form molded double brush blanks placed back to back having said yarns protruding from said two opposite sides;

removing said double brush blanks after said synthetic material has been at least sufficiently hardened in said mold cavity to maintain its molded shape;

dividing said molded double brush blanks into individual brush blanks by cutting them along the longitudinal axis of said double brush blanks; and cutting said projecting yarns of each individual brush blank at a desired length so as to obtain completed individual brushes.

2. A process according to claim 1 wherein cutting said molded brush blanks along their longitudinal axis causes said yarns to be cut on one side of said brush blank so as to be flush with a surface of said brush head.

3. A process according to claim 1, further comprising passing said continuous parallel yarns used for forming said bristle or pile of said brushes through a plurality of small parallel holes provided in said two opposite sides of said mold at said part of said cavity having the shape of a double brush head.

4. A process according to claim 1, further comprising exerting a traction or pulling force on said parallel yarns, so as to submit them to a suitable tension while crossing said mold cavity.

5. A process according to claim 1, further comprising performing said cutting operations mechanically, thermally or optically.

6. A process according to claim 5, further comprising using polyfilament yarns and cutting said molded double brush blanks along said longitudinal axis by means of a laser beam emitting device causing ends of filaments of each yarn to be cut flush with one surface of said brush head and to cause said filament ends and said one surface to become fused together.

7. A process according to claim 1, further comprising drawing said parallel monofilament or polyfilament yarn sections into said mold cavity, stopping said filament sections during said molding, sending said yarns to which said double brush blanks are attached to lower cutting stations, cutting said double brush blanks along said longitudinal axis, so as to obtain a first completed brush, cutting said protruding yarns at a desired length on the side of the second brush blank, directed towards said mold to thereby obtain said second brush in completed form.

* * * * *